United States Patent [19]

Faller et al.

[11] Patent Number: 4,627,225

[45] Date of Patent: Dec. 9, 1986

[54] LOADING APPARATUS FOR A PACKAGING MACHINE FOR SMALL PRODUCTS

[75] Inventors: Peter Faller, Biberach; Herbert Rittinger; Detlev Gertitschke, both of Laupheim, all of Fed. Rep. of Germany

[73] Assignee: Josef Uhlmann Maschinenfabrik GmbH & Co. KG, Laupheim/Wurtt., Fed. Rep. of Germany

[21] Appl. No.: 729,440

[22] Filed: May 1, 1985

[30] Foreign Application Priority Data

May 2, 1984 [DE] Fed. Rep. of Germany ..... 3416200
Sep. 12, 1984 [DE] Fed. Rep. of Germany ..... 3433371

[51] Int. Cl.[4] ..... B65B 55/24

[52] U.S. Cl. ..... 53/510; 53/244; 53/432; 53/560; 141/93

[58] Field of Search ..... 53/79, 235, 244, 403, 53/432, 510, 560; 141/89, 90, 93; 221/211

[56] References Cited

U.S. PATENT DOCUMENTS

| | | | |
|---|---|---|---|
| 3,028,713 | 4/1962 | Kennedy et al. | 53/244 |
| 3,064,406 | 11/1962 | Kennedy et al. | 53/244 |
| 4,296,523 | 10/1981 | Clark | 141/93 |
| 4,312,388 | 1/1982 | Hager et al. | 141/93 |
| 4,471,820 | 9/1984 | Lepisto | 141/89 |

FOREIGN PATENT DOCUMENTS

| | | | |
|---|---|---|---|
| 480403 | 1/1952 | Canada | 53/244 |
| 2262951 | 6/1974 | Fed. Rep. of Germany . | |

*Primary Examiner*—John Sipos
*Assistant Examiner*—Donald R. Studebaker
*Attorney, Agent, or Firm*—Karl F. Ross; Herbert Dubno

[57] ABSTRACT

The loading apparatus of our invention comprises a filling shoe for input of small products, particularly pharmaceutical products, into a plurality of receptacles of a package component moving by and below the filling shoe. The filling shoe is provided with at least one feed chamber for receiving and dispensing the product which has a mouth opening below to the package component. A product duct for feeding the products one after the other is connected to and ends in the feed chamber. Each feed chamber is connected to at least one vacuum passage which is connected to and communicates with a vacuum source. The front side of the feed chamber in the motion direction of the package component may be formed as a guide slope running slantedly downward toward the package component opening in or to a vacuum passage with the feed chamber and to the package component. Vacuum slots may be provided running in a wall of the product duct and ending in the feed chamber to augment the vacuum effect in the product duct.

12 Claims, 25 Drawing Figures

LOADING APPARATUS FOR A PACKAGING MACHINE FOR SMALL PRODUCTS

FIELD OF THE INVENTION

Our present invention relates to a loading apparatus for a packaging machine used in packaging small articles, particularly pharmaceutical products such as tables, pills, capsules, oblong products and the like.

BACKGROUND OF THE INVENTION

Known loading devices for packaging machines for the purposes described can be provided with a filling shoe for feeding small articles into a plurality of receptacles, preferably molded receptacles, of a package component moving below the filling shoe and past it.

Examples of this package component include a molded foil or a molded plate with a slidable partition positioned between the molded plate and a molded foil having molded receptacles therein, wherein the filling shoe has at least one feed chamber, which has a mouth open to the package component and its receptacles and into which a product duct empties feeding the product items in series one after another.

In the loading apparatus of this type in the prior art, the force of gravity is not sufficient to slide the articles quickly enough through the product duct into the feed chamber so that it falls out of the feed chamber into a preferably molded receptacle. It is known to speed up the product feed by a pressurized air flow, which is provided through an air passage connected just in front of the end of the feed chamber, so that the air flow acts only on the product found directly in front of the feed chamber.

The material therefore blown into the feed chamber reaches one of the receptacles into which it drops as before by free fall, because on the latter part of its trajectory acceleration by the pressurized air flow is absent. The air escapes from the feed chamber substantially through the gap between the filling shoe and the package component and, if necessary, also through an air escape passage connected to the feed chamber.

With the increasing speed of the package component feed, the filling speed of the product must also increase and therefore the speed of the air flow must also be elevated. That however has the disadvantage that a strong air vortex arises in the receptacles, which produces a back pressure and hinders the fall of the product from the feed chamber into the receptacles. The product which does not quickly enough reach the preferably molded receptacle can hang between the edges of the feed chamber and the preferably molded receptacle and as a result of the package component motion be damaged.

With a correspondingly higher air flow the damming-up effect of the air vortex is so strong that the product no longer reaches the bottom of one of the receptacles, but hangs in or over the receptacle and under certain circumstances is blow from the receptacle. Because of that the filling speed has an upper limit with this system.

A further disadvantage of the above-described pressurized air flow method for product feed and load assistance is that dust build up is not prevented. The dust carried along by the air flow into the outlet from the feed chamber pollutes the sealing surfaces of the packaging foil. Still more serious however is the fact that the dust carried by the pressurized air to the outside into the environment originates as a rule from the product and also can originate from its filling, when for example the capsules are damaged. Often it is a matter of a highly biologically active material such as sleeping pills, hormonal stimulants and materials, poisons or the like, by which the surroundings and persons functioning therein can be heavily dosed and correspondingly affected.

Further disadvantages of the pressurized air flow method are seen in the increased consumption of materials and a correspondingly increased cost as well as an annoying, disturbing air flow noise. Besides the pressurized air flow from the pressurized air source contaminates and renders nonsterile everything it contacts.

OBJECTS OF THE INVENTION

Our invention is based on a desire to provide a loading apparatus of the above-described kind so that a higher filling speed can be attained than is achieved by free fall of the product or with a pressurized air flow.

It is an object of our invention to provide an improved loading apparatus for a packaging machine for packaging small, articles particularly pharmaceutical products such as tablets, pills, capsules and the like.

It is also an object of our invention to provide an improved loading apparatus for packaging small pharmaceutical products having a higher filling speed than prior art loading apparatuses, while packaging the product in a reliable way without contamination of the environment.

It is a further object of our invention to provide an improved loading apparatus for the above-described kind which has a higher filling speed than is achieved by known pressurized air flow oading apparatuses or by free fall of the product.

It is yet another object of our invention to provide an improved loading apparatus of the above-described kind which packages products quickly, but does not jam because of dust formation nor contaminate the environment.

SUMMARY OF THE INVENTION

These objects and others which will become apparent heeinafter are attained in accordance with our invention in a loading apparatus for a packaging machine for small articles, particularly pharmaceutical products including tablets, pills, capsules and the like with a filling shoe for input of the products into a plurality of preferably molded receptacles of a package component moving past and below the filling shoe. The package component comprises typically a molded plate, a molded foil, or a molded plate with a slidable partition arranged between the molded plate and a molded foil having the receptacles therein.

The filling shoe has at least one feed chamber formed therein, which has a mouth opening directly to the product package and its receptacles. The feed chamber has a product duct connected to it which ends at the feed chamber and delivers products one after the other to the feed chamber from which they are dispensed to the receptacles.

According to our invention at least one vacuum passage is connected to the feed chamber, this vacuum passage being connected to and communicating with a vacuum source.

A flow of air being evacuated thus arises in the product duct and the feed chamber as a result of the vacuum passage with its associated vacuum source, which of course speeds the product on its way in the feed chamber without leading to a flow vortex in the receptacle which would hinder the transfer of the product into the receptacle.

No pneumatic back pressure can develop in the transfer from the feed chamber into the receptacle. Usually the air flow acts directly not only on the article at the downstream port of the feed chamber, but upon all of the products in the entire length of the product duct.

Moreover as permitted by the appropriately shaped feed chamber and its connections to the vacuum passage or passages the vacuum effect acting on the product in the feed chamber and in its transfer into the preferably molded receptacle influences the speed and direction desired so that particularly reorientation of the product in its transfer from the product duct through the feed chamber into the preferably molded receptacle is optimally assisted and sped up, while when forced air flow is used this possibility does not exist.

As a result the filling speed is increased substantially when our invention is used.

An additional important advantage of the flow of air being evacuated is that the air being evacuated originates directly from the surroundings of the packaging machine, which is therefore sterile and clean, when the machine is operated in the vicinity of clean air as is usually the case in pharmaceutical packaging.

Preferably a filter for solids on input of the product removes broken or residual pieces and dust from the air flow so that they are not transmitted to the surroundings. The same goes for products damaged on input. By suitably shaping and dimensioning of the effective evacuation cross section in the feed chamber, articles having even only slight damage can be sucked out as a result of changes in shape by the flow of air being evacuated.

Thus filling errors and interference with the operating cycle of the machine, for example in sealing or in filling control, which are not possible to cover up without more, can certainly be avoided. All solid materials, excepting of course the product itself, carried along by the flow of evacuated air are easily removed from the air flow and thus the surroundings remain safe, when a filter for solids is provided.

The vacuum effect of the flow of air being evacuated can more easily influence the interior of the product duct if vacuum slots run in the wall of the product duct and end in the feed chamber. Often it is sufficient that these vacuum slots are found only in the end portion in front of the feed chamber.

Another embodiment of our invention is particularly characterized by the feed chamber being connected to the vacuum passage by at least one vacuum groove open toward the package component. The position and course of the vacuum groove or grooves influences the size of the underpressure and suction operating in the feed chamber and in the molded receptacles.

According to another feature of our invention the filling shoe has a feed chamber into which the product duct, inclined in a plane substantially perpendicular to the motion direction of the package component, opens. The vacuum groove is provided in the side of the feed chamber at the mouth of the product duct, which is inclined at an acute angle to the motion direction of the package component.

The vacuum effect arising from this vacuum groove can directly act on the product in such a way that it requires and speeds up the necessary direction change of the product in transfer from the product duct to the preferably molded receptacles.

A speed up of this transfer is achieved very advantageously and effectively, when the front side of the feed chamber in the motion direction of the product is formed as a guide slope running slanted toward the package component in the motion direction of the product, and the vacuum groove or grooves runs or run along the guide slope.

This has the result that a product found both in the feed chamber and already in the molded receptacle is pivoted by the air flow into the motion direction of the package component even when the wall of the molded receptacle to the rear in the motion direction of the package component has not yet been reached by the product.

As a result therefore motion is imparted to the article to guarantee the damage-free transfer of the product into the receptacle and also a greater running speed for the package component.

Another suitable embodiment is particularly characterized by only a single vacuum groove, this vacuum groove running to the feed chamber in the center of the slope surface of the guide slope. Yet another embodiment with two vacuum grooves is particularly characterized by the vacuum grooves running on each side of the slope surface of the guide slope.

The formation of the feed chamber in particular is arranged according to the type and condition of the product and its feed in the product duct. It is to be considered that not only the feed space must allow the separation of the product from the product column formed in the product duct, but also if necessary an orientational change of the product must be permitted, when the orientation which the product arriving from the product canal into the feed chamber has does not coincide with the orientation in the molded receptacle.

The simplest embodiment of our invention is therefore that in which the feed chamber is so constructed that it takes the product in the orientation corresponding to its final position in the preferably molded receptacle. The needed product falls into the passing molded receptacles accelerated by the air being evacuated.

Another preferred embodiment of our invention, particularly for oblong products, is characterized by the long axis of the feed chamber and the molded receptacle lying transverse to the motion direction of the package components and the product duct opens into the feed chamber substantially in that direction, and that the wall of the feed chamber lying opposite to the mouth of the product canal is slanted toward the package component.

Advantageously in addition to the guide slope in front of said feed chamber, the feed chamber has a chamber segment between the mouth of the product duct and the beginning of the guide slope with a passagelike cross section, the passagelike cross section corresponding to the projection of the part of the product protruding into the feed chamber as seen in the motion direction of the package component from the receptacle.

A further particularly important improvement of the loading speed of the product is therefore possible, when the package component is constructed as a molded plate. In this case the feed chamber of our invention is connected through the preferably molded receptacles to vacuum passages provided in a slidable partition, so that the flow of air being evacuated is put through the molded receptacles in the same direction as the feed of the product occurs, the product therefore is particularly effectively drawn into the receptacle.

BRIEF DESCRIPTION OF THE DRAWING

The above and other objects, features and advantages of our invention will become more readily apparent from the following detailed description, reference being made to the accompanying drawing in which.

SPECIFIC DESCRIPTION

Figure 1:
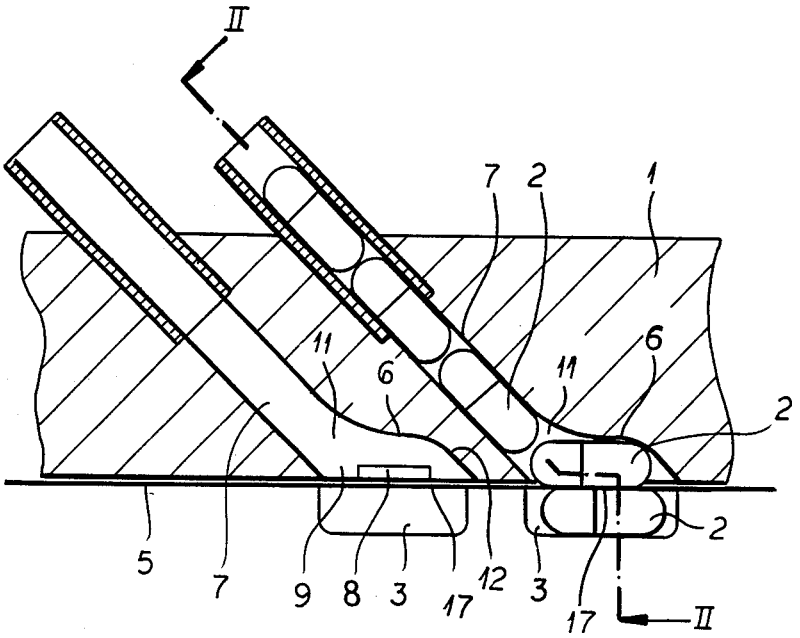
FIG. 1 is a vertical cross sectional view through a filling shoe of the loading apparatus according to our invention, taken in the motion direction of the package component.
Figure 2:
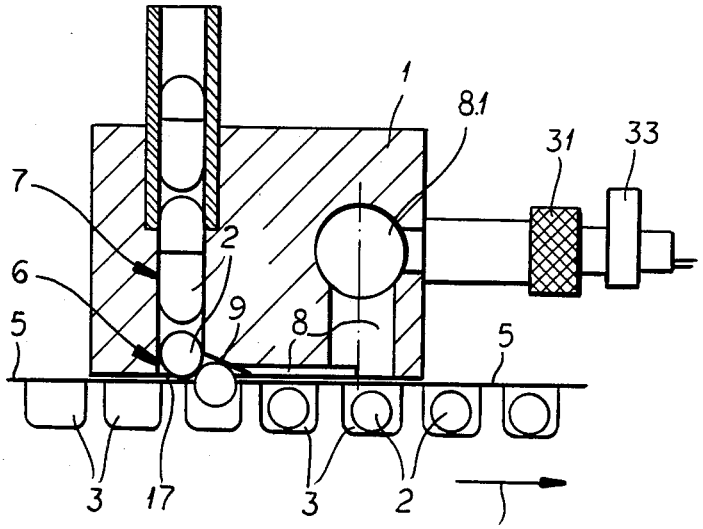
FIG. 2 is a cross sectional view of the loading apparatus according to FIG. 1 taken along the section line II—II thereof.
Figure 3:
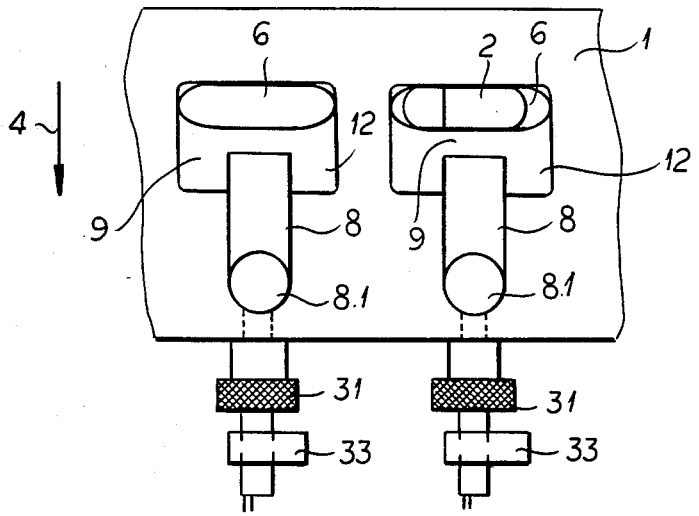
FIG. 3 is view of the filling shoe of FIGS. 1 and 2 as seen from its underside.

The product 2 to be packaged can be oblong products in capsule form as shown in FIGS. 1 to 4 or tablets having an approximately circular cross section as shown in the remaining figures. However it is understood that our invention is not limited to such a tablet. Rather the described and illustrated systems are suitable for all product shapes and dimensions occuring in pharmaceuticals.

A filling shoe 1 functions as an input device for the product 2. The product 2 is fed into a preferably molded receptacle 3 of a package component 5 moving past filling shoe 1 in the direction of the arrow under filling shoe 1.

The package component 5 can, as shown in FIGS. 1 to 18 be a plastic-molded foil perhaps a PVC foil with molded receptacles 3 in it made by deep drawing. The package component 5 can, however, also be formed as a molded plate containing the molded receptacle 3. Finally, between the molded plate and a molded foil 5', which receives the product in its own molded receptacles 3', a slidable partition 1' can be positioned which is movable back and forth with respect to the molded plate in the direction of the arrows 4*a*.

When the drop openings 3*a* in the slidable partition 1' coincide with the molded receptacles 3 in the molded plate, the product 2 contained in the molded receptacles 3 can fall through the drop openings 3*a* into the molded receptacles 3' in the temporarily halted molded foil 5', which then moves in synchronized fashion in the direction of arrow 4*b*. The motion of the package component 5 compared to filling shoe 1 is understood in each case to be a relative motion.

Figure 19:
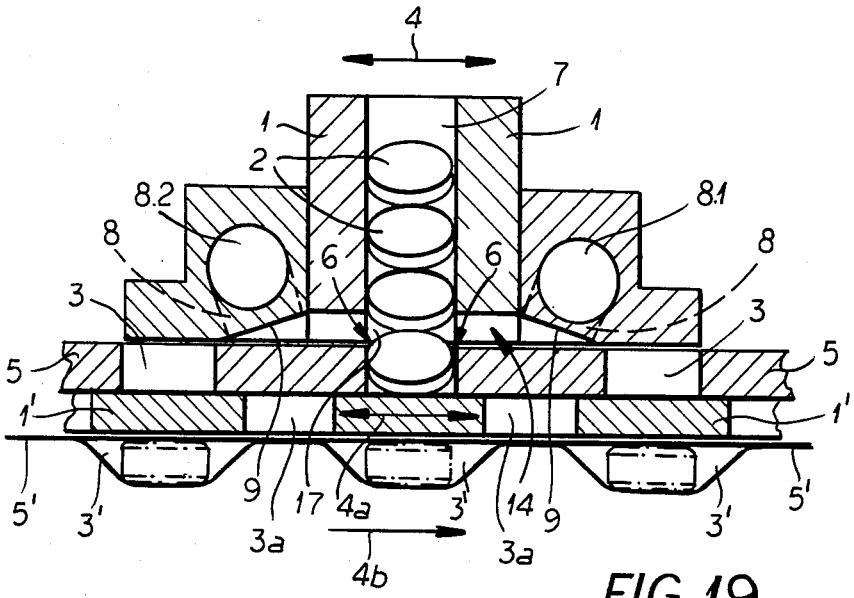
FIG. 19 is a vertical cross sectional view similar to that of FIG. 18 through a specific embodiment of our invention having a plate shaped to receive the product.
Figure 20:
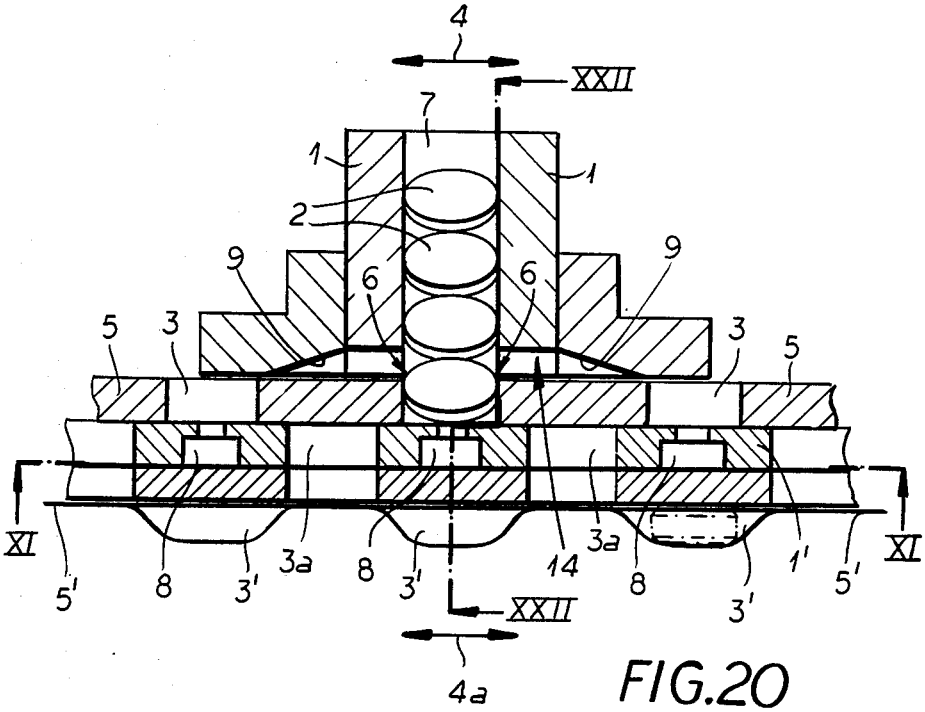
FIG. 20 is a vertical cross sectional view of an additional embodiment of our invention shown in a view corresponding to that of FIG. 19.

Instead of the package component 5 moving compared to the halted filling shoe 1, the filling shoe 1 can also be moved with respect to the package component 5 constructed as a molded plate 5, as is the case in the specific embodiment according to FIGS. 19 and 20, where the filling shoe 1 is moved in the direction of the double arrows 4 with respect to the molded plate formed as the halted package component 5.

Also the possibility exists to move the package component 5 in the same direction as the filling shoe 1, but with a different velocity to maintain a small velocity difference between the package component 5 and the filling shoe 1, in order to provide a longer time for passage of the product 2 into the molded receptacle 3 than with the stationary filling shoe 1. However, in particular, the relative motion may be provided and the package component 5 may be constructed so that the illustrated loading apparatus with direct loading into the molded foil are suitable for leading into a molded plate and slidable partition. This is particularly true for FIGS. 5 to 7.

In each specific embodiment the filling shoe 1 has a feed chamber 6 for transfer of the product 2. The feed chamber 6 has a mouth 17 on its underside open to the package component 5 and is connected to a product duct 7 to which the product 2 is fed from an unshown magazine or storage unit connected serially to the feed chamber 6.

This product duct 7 can run vertically above the feed chamber 6, as in FIGS. 5 and 7. In the specific embodiment shown in FIGS. 8 to 11, the product duct 7 runs slanted in a vertical plane parallel to the motion direction 4 of the package component 5, while in all other embodiments the product duct 7 runs slanted or inclined in a stationary plane perpendicular to the motion direction 4 of the package component 5.

Figure 4:
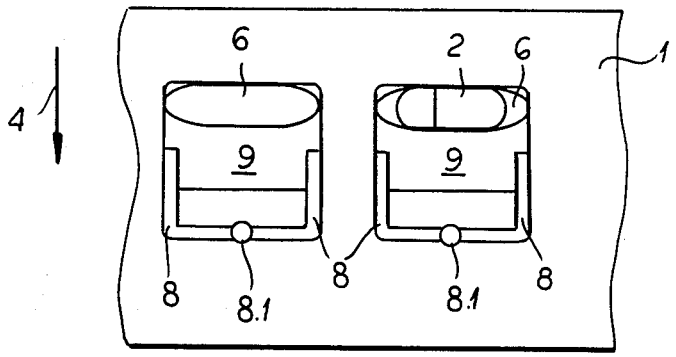
FIG. 4 is a view similar to FIG. 3 of an alternative embodiment of the filling shoe of the loading apparatus according to our invention.

In the specific embodiment according to FIGS. 1 and 4, the oblong articles which comprise the product 2 are arranged in series with their long axes in the direction of the product duct 7.

Figure 5A:
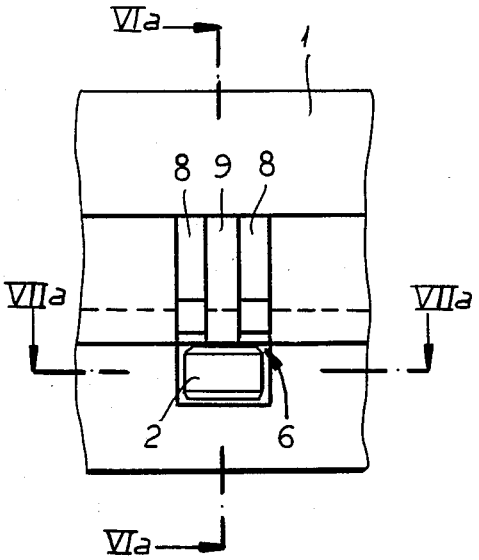
FIGS. 5*a* and 5*b* are bottom views of other embodiments of the filling shoe of the loading apparatus according to our invention corresponding to the view shown in FIGS. 3 and 4.
Figure 5B:
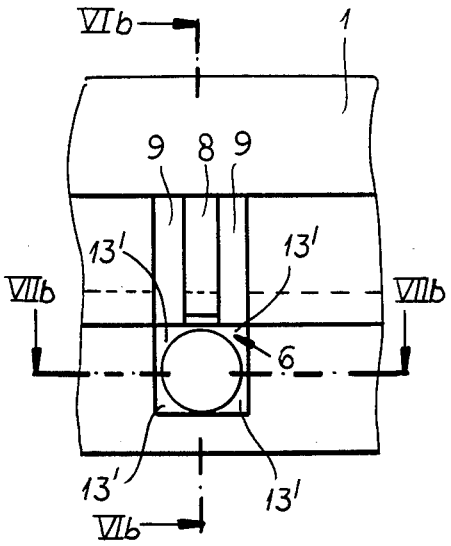
Figure 6A:
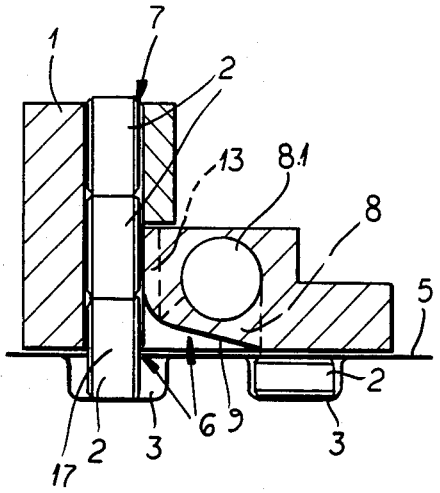
FIG. 6*a* is a vertical cross sectional view of the loading apparatus according to FIG. 5*a* taken along the section line VI*a*—VI*a* in FIG. 5*a;*
Figure 6B:
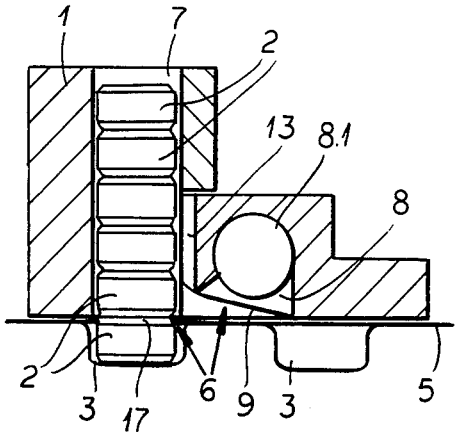
FIG. 6*b* is a vertical cross sectional view of the loading apparatus according to FIG. 5*b* taken along the section lines VI*b*—VI*b* in FIG. 6*b;*
Figure 7A:
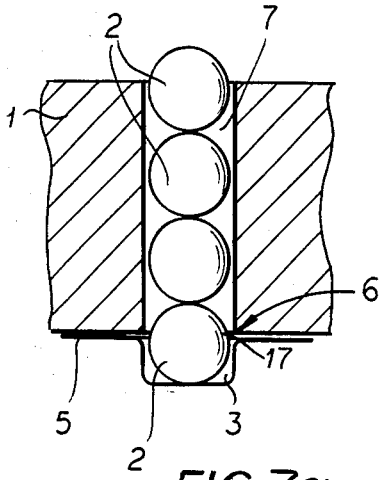
FIG. 7*a* is a cross sectional view of the loading apparatus according to FIG. 5*a* taken along the section line VII*a*—VII*a* in FIG. 5*a;*
Figure 7B:
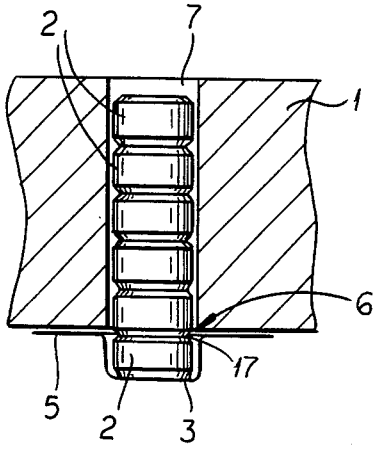
FIG. 7*b* is a cross sectional view of the loading apparatus according to FIG. 5*b* taken along the section line VII*b*—VII*b* in FIG. 5*b;*
Figure 8:
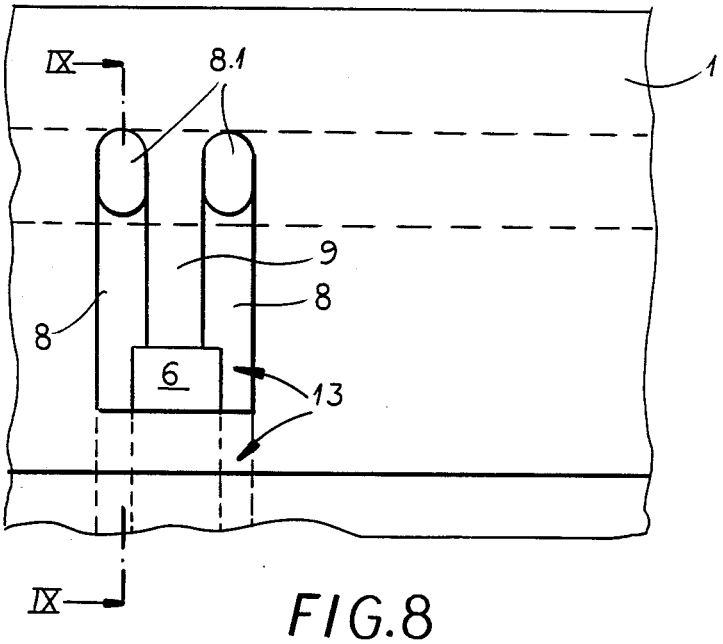
FIG. 8 is a view of another embodiment of the loading apparatus of our invention from the bottom corresponding to FIGS. 3, 4, 5*a* and 5*b;*
Figure 9:
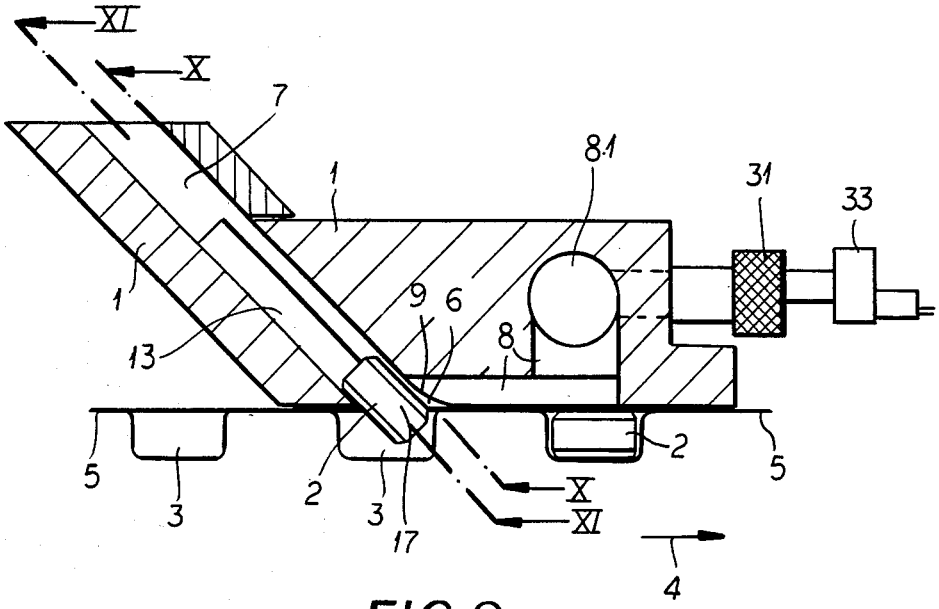
FIG. 9 is a vertical cross sectional view of the loading apparatus according to FIG. 8 taken along the section line IX—IX in FIG. 8.
Figure 10:
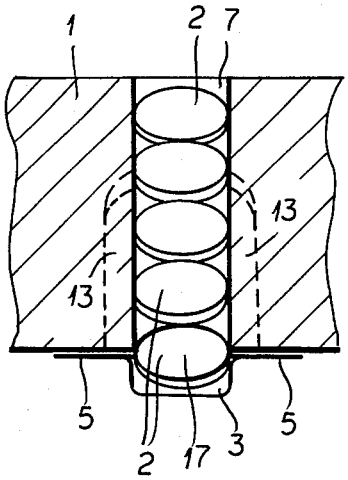
FIG. 10 is a cross sectional view of the loading apparatus taken along the section X—X in FIG. 9.
Figure 11:
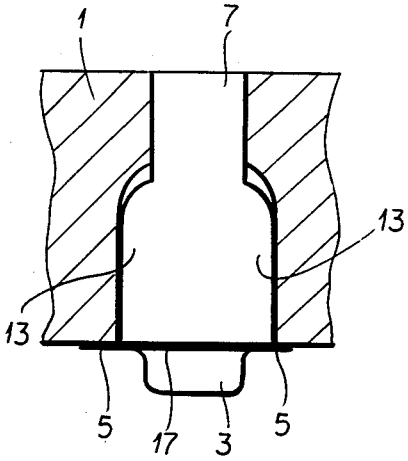
FIG. 11 is a cross sectional view of the loading apparatus taken along the section line XI—XI in FIG. 9 in the direction of the arrows.
Figure 12:
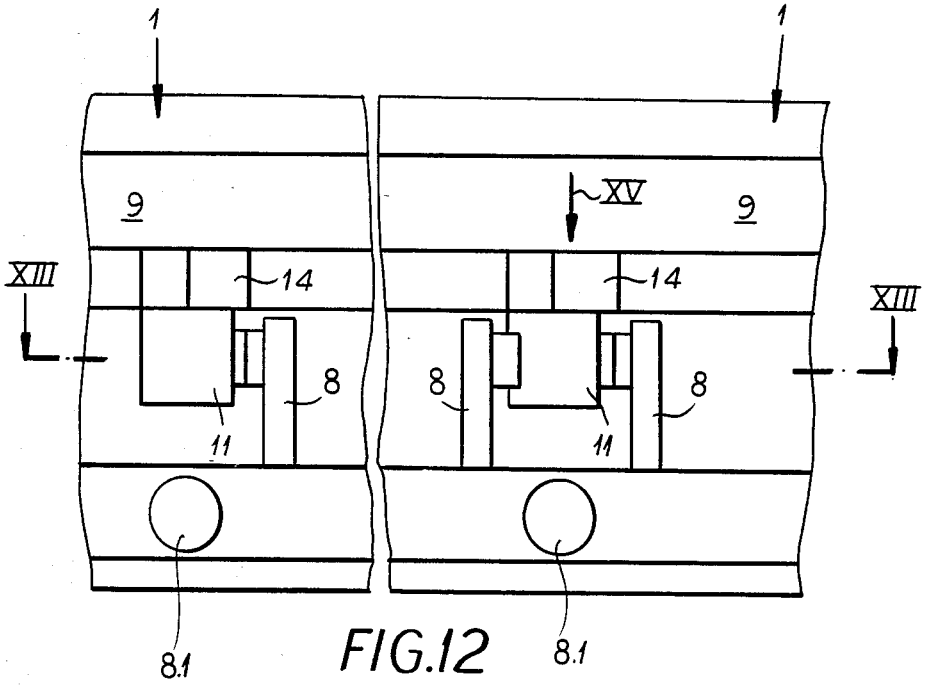
FIG. 12 is a view of another specific embodiment of our invention, again showing two examples similar to FIG. 5 shown side-by-side.
Figure 13:
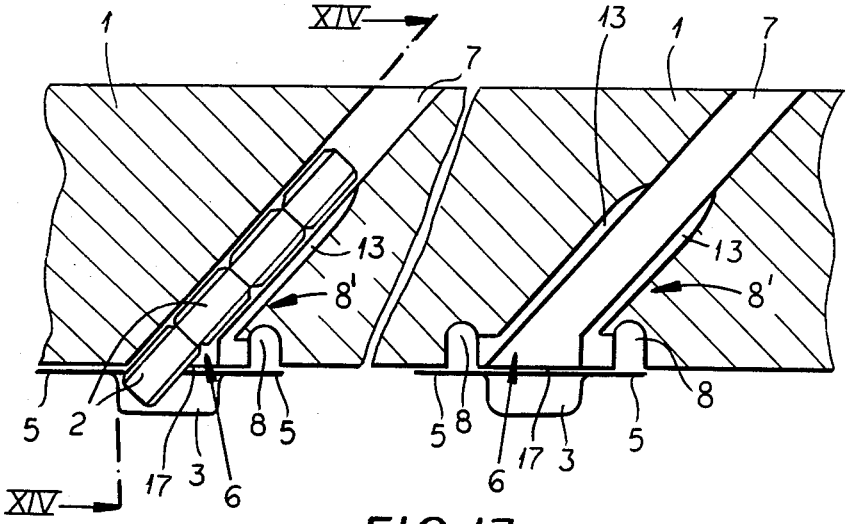
FIG. 13 is a vertical sectional view of the loading apparatus of our invention taken along the section line XIII—XIII of FIG. 12.
Figure 14:
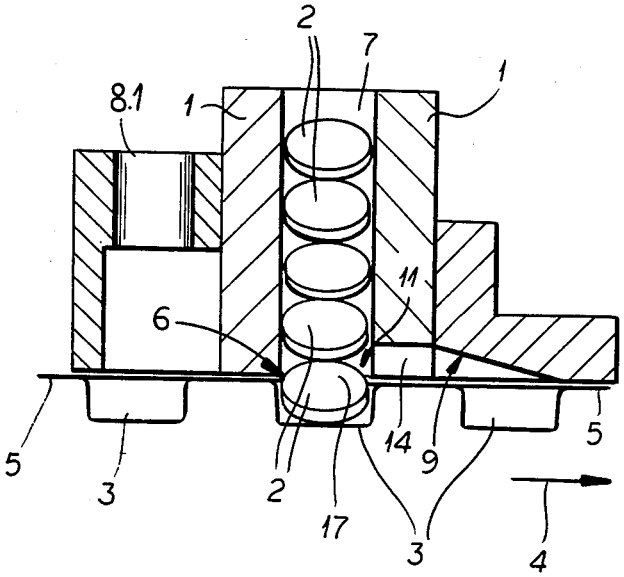
FIG. 14 is a cross sectional view taken along the section line XIV—XIV of FIG. 13.
Figure 15:
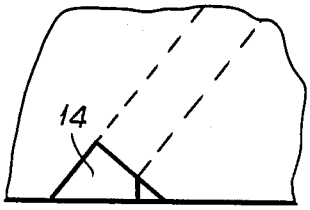
FIG. 15 is a cross sectional view of part of the apparatus of our invention as seen in the direction of arrow XV of FIG. 12.
Figure 16:
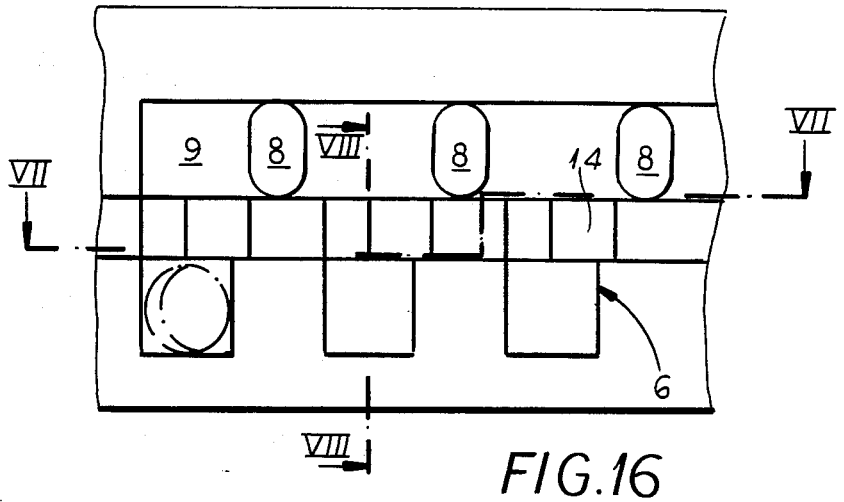
FIG. 16 represents yet another embodiment of our invention as seen in a view corresponding to FIGS. 8 and 12.
Figure 17:
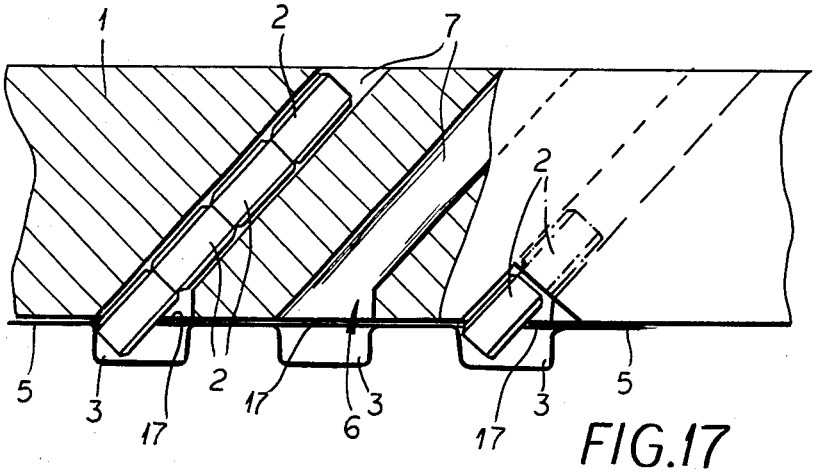
FIG. 17 is a vertical cross sectional view of the apparatus of our invention taken along the section line XVII—XVII of FIG. 16.
Figure 18:
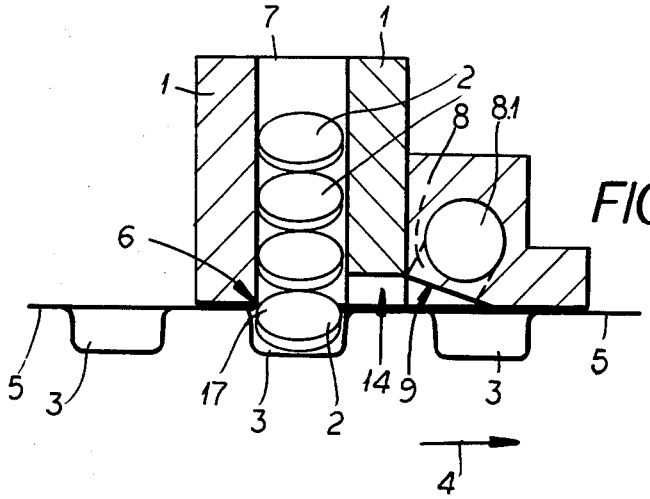
FIG. 18 is a cross sectional view taken along the section line XVIII—XVIII of FIG. 16.

In the specific embodiment according to the FIGS. 5*b*, 6*b*, and 7*b*, the tablets lie with their circular surfaces on each other and are stacked also coaxially in the product duct 7, while in all other embodiments they push against each other generally edgewise in product duct 7, therefore touching only at their periphery.

As a rule in the simplest specific embodiments only one feed chamber 6 is shown. In practice however, in order to be able to fill simultaneously several molded receptacles 3, most devices are correspondingly provided with several feed chambers 6 side-by-side, as in the embodiments of FIGS. 1 to 4 or FIGS. 20 to 22 each having two feed chambers 6, and in the embodiment of FIGS. 16 to 18 which has three feed chambers.

As a result, the filling shoe 1 has a feed chamber 6 with a product duct 7 for each receptacle 3 simultaneously available for filling. This arrangement can be expanded to an arbitrary plurality of molded receptacles 3 arranged in series next to each other transverse to the motion direction 4 of the package component 5.

In all embodiments the feed chamber 6 is connected to at least one vacuum passage 8.1 or 8.2, which is connected with a vacuum source, for example a vacuum pump 33, which can be largely optionally constructed, as long as sufficient suction and evacuation efficiency are provided.

In the flow of air being evacuated downstream from the feed chamber 6 and the vacuum passage 8.1 and 8.2 a filter 31 for solids can likewise be provided, which filters out and separates dust or powder originating by abrasion of the product 2 or broken or residual pieces of damaged products 2 traveling along in the flow of air being evacuated by the vacuum pump 33.

The feed chamber 6 is connected to the vacuum passage 8.1 and 8.2 by one or more vacuum grooves 8. These vacuum grooves 8 are open to the package components 5. Since the product duct 7 is inclined in a plane substantially perpendicular to the motion direction 4 of the package component 5, as is the case in FIGS. 12 to 14, the suction groove 8 should be provided on the side of the feed chamber 6 in the side 8' of the product duct 7 adjacent mouth 11 making an acute angle with the package component 5 so that the vacuum acts on the product 2 which requires direction change and expedites the appropriate change of direction of the product on impact on the horizontal surface.

Usually the front side of the feed chamber 6 in the embodiment in the motion direction 4 of the package component 5 is formed as a slanted guide slope or flank 9 opposite to the package component 5, and is inclined in that direction. The vacuum groove 8 runs therefore along the guide slope 9. One vacuum groove 8 only is present in the specific embodiments according to FIGS. 3, 5*b* or 6*b*; this vacuum groove 8 runs to the feed chamber 6 in the center of the slope surface of the guide slope 9.

Two vacuum grooves 8 may be connected to each feed chamber 6, as in the specific embodiments according to FIGS. 4 and 5*a* or 6*a*, there vacuum grooves 8 run on both sides of the slope surface of the guide slope 9.

The suction operation of the vacuum inside of the product duct 7 can be influenced by the vacuum slots 13, as in the specific embodiments of FIGS. 6*a*, 6*b*, 9 to 11 and 13. They run in the wall of the product duct 7 and end at the feed chamber 6. This kind of vacuum slot indicated by 13' can, however, also, as in FIGS. 5*b* to 7*b*, be formed between the cylindrical product column and the square feed product duct 7. Here the vacuum operation is best at the four corner vacuum slots 13' along the product column.

The feed chamber 6 can be constructed as in FIGS. 1 to 4 or 5*b*, 6*b* and 7*b*, so that it can take the product in the orientation corresponding to that of its final position in the receptacle 3 directly. Frequently, however, it is the case that the feed chamber 6 must permit a reorientation of the product 2 from its position in the product canal 7 into a different position of the product 2 in the molded receptacle 3.

Here the already selected guide slope 9 plays a different role in which it forces on the product 2 a change in course necessary for this reorientation.

The specific embodiments according to FIGS. 5*a*, 6*a* and 7*a*, particularly, are typical cases of this type, where the product 2 standing at first edgewise is converted to the horizontal flat position at the guide slope 9. Similar advantages exist in the case of FIGS. 8 to 11, so again the guide slope 9 provides for the rotation of the product 2 input in a slanted inclined position along the guide slope 9 into the horizontal flat position desired for the molded receptacle 3. In the embodiments according to FIGS. 12 to 14 and 16 as well as FIGS. 20 to 22 the feed chamber 6 has usually between the mouth 11 of the product duct 7 and the beginning of the guide slope 9 a chamber segment 14 with a passagelike cross section, which corresponds to the projection seen in the motion direction 4 from the molded receptacle 3 of the package component 5 of the part of product 2 protruding into the feed chamber 6 in the inclination determined by the product duct 7. In this chamber segment 14 the reorientation of the product 2 occurs during its forward motion, which is then completed along the guide slope 9.

The feed chamber 6 in contrast, as has already been mentioned, can take the product 2 completely by itself immediately and without assistance. As seen in FIGS. 1 to 4, the product 2 being brought from the feed chamber 6 falls directly into the molded receptacle 3, only when the molded receptacle 3 passes the mouth 17 of the feed chamber 6. In the example shown in the summary, for oblong products the long axes of the feed chamber 6 and the molded receptacle 3 lie transverse to the motion direction 4 of the package component 5. The product duct 7 opens into the feed chamber 6 substantially in the direction of the long axis of the feed chamber 6. The mouth 11 of the product duct 7 lies substantially opposite wall 12 of the feed chamber 6 which is inclined toward the product receptacle 5 and is usually rounded concave so that a product 2 arriving from the product canal 7 into the feed chamber 6 can be deflected below at this chamber wall 12.

The specific embodiment represented in FIGS. 19 and 20 to 22 with the package component 5 constructed as a molded plate shows the case in which the filling shoe 1 movable back and forth in the direction of double arrows 4 over the package component 5 can feed the molded receptacle 3 in the direction of both motions.

In addition the filling shoe 1 in the specific embodiment according to FIG. 19 is constructed completely symmetrically in regard to both directions of motion with respect to the feed chamber 6, the vacuum groove 8 and the vacuum passage 8.1 and 8.2, wherein alternatively vacuum passage 8.1 or 8.2 is connected with the vacuum source.

Figure 21:
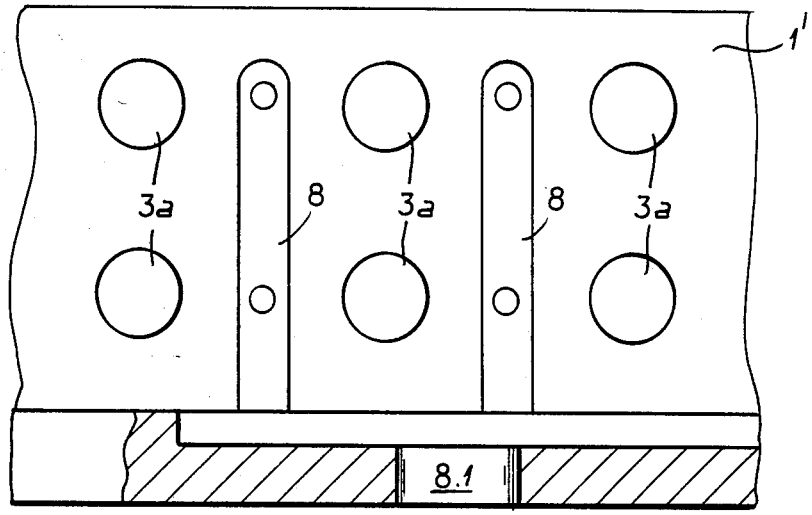
FIG. 21 is a cross sectional view taken along the section line XXI—XXI of FIG. 20.
Figure 22:
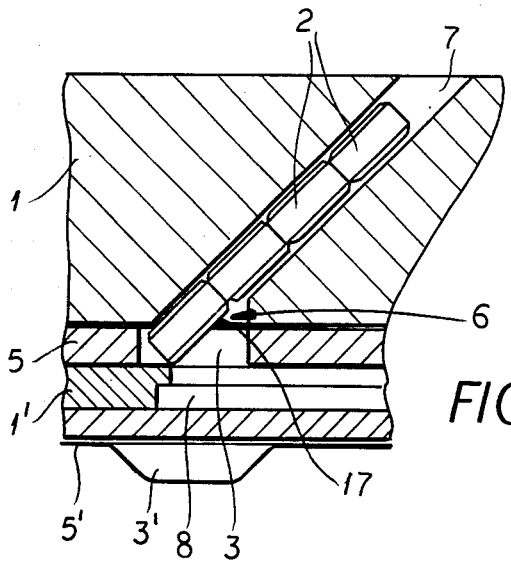
FIG. 22 is a vertical cross sectional view taken along the section line XXII—XXII of FIG. 20.

In FIGS. 20 to 22 the case is illustrated, in which the feed chamber 6 is connected to the vacuum groove 8 provided in the slidable partition 1' down through the molded receptacle 3. That has the result that each molded receptacle 3 during its filling in the direction of feed of the product, also from above to below, is partly evacuated by the vacuum source and because of that the product 2 is drawn into the molded receptacle 3 from the feed chamber 6 in a particularly effective way.

We claim:

1. A loading apparatus for a packaging machine for small products comprising:

a filling shoe for input of said products into one of a plurality of receptacles of a package component moving past and under said filling shoe;

means to move said receptacles in a given direction past said filling shoe;

at least one feed chamber formed in said filling shoe and having a mouth open toward said package component and a receptacle of said package component aligned with said chamber to receive a product therefrom;

a product duct communicating with said feed chamber for feeding said products in series one after another to said feed chamber;

at least one vacuum passage formed in said shoe and connected with a vacuum source for evacuating a flow of air, said passage opening into said chamber at a location other than that at which said duct is connected thereto and adjacent said mouth and being formed as a groove in said given direction in said shoe opening directly toward said component and into said receptacle aligned with said chamber to remove dust and facilitate the transport of said products into said receptacles.

2. The apparatus defined in claim 1 wherein said vacuum source is a vacuum pump.

3. The apparatus defined in claim 1, further comprising at least one filter for solids in the path of the flow of the air being evacuated.

4. The apparatus defined in claim 1, further comprising at least one vacuum slot connected to said source formed in the wall of said product duct and ending in said feed chamber.

5. The apparatus defined in claim 1 wherein said product duct opens into said feed chamber slantedly in a plane substantially perpendicular to a motion direction of said package component, said vacuum groove being provided adjacent said mouth of said feed chamber in a side of said product duct and said package component including an acute angle between them.

6. The apparatus defined in claim 5 wherein a guide slope running slantedly toward said package component is formed in a front side of said feed chamber in said motion direction of said package component, and at least one of said vacuum grooves is positioned so as to run along said guide slope.

7. The apparatus defined in claim 6 wherein said guide slope has only one such vacuum groove therein and said vacuum groove runs to said feed chamber in the center of the slope surface of said guide slope.

8. The apparatus defined in claim 6 wherein said guide slope has two such vacuum grooves and each of said two of said vacuum grooves run on each opposing side of the slope surface of said guide slope.

9. The apparatus defined in claim 6 wherein said feed chamber has a chamber segment between the mouth of said product duct and the beginning of said guide slope with a passagelike cross section, said passagelike cross section corresponding to the projection of the part of said product protruding into said feed chamber as seen in said motion direction of said package component from said receptacle, wherein the orientation of said product is still determined by the slope of said product duct.

10. The apparatus defined in claim 1 wherein said feed chamber receives said product directly in the orientation corresponding to the final orientation of said product in said receptacle.

11. The apparatus defined in claim 10 wherein for oblong products the long axes of said feed chamber and said receptacles lie transverse to the motion direction of said package component and said product duct opens into said feed chamber substantially in said motion direction of said package component and that the wall of said feed chamber lying opposite the mouth of said product duct is inclined toward said product package.

12. The apparatus defined in claim 1 wherein said package component is constructed as a molded plate having a slidable partition between said molded plate and a molded foil, said feed chamber being connected through said receptacle to said vacuum passage which is positioned in said slidable partition.

* * * * *